US005274357A

United States Patent [19]

Riordan

[11] Patent Number: 5,274,357

[45] Date of Patent: Dec. 28, 1993

[54] COMBINED ALARM SYSTEM AND WINDOW COVERING ASSEMBLY

[76] Inventor: Dennis E. Riordan, 2326 Sawtelle Blvd., Los Angeles, Calif. 90064

[21] Appl. No.: 831,861

[22] Filed: Feb. 5, 1992

[51] Int. Cl.[5] ..... G08B 13/08; G08B 13/12

[52] U.S. Cl. ..... 340/550; 160/10; 340/545; 340/547

[58] Field of Search ..... 340/550, 545, 547; 160/10

[56] References Cited

U.S. PATENT DOCUMENTS

| | | | |
|---|---|---|---|
| 4,281,320 | 7/1981 | Rosenberg | 340/545 |
| 4,293,778 | 10/1981 | Williams | 340/550 |
| 5,049,855 | 9/1991 | Slemon et al. | 340/550 |

*Primary Examiner*—Glen R. Swann, III

*Attorney, Agent, or Firm*—W. Edward Johansen

[57] ABSTRACT

A combined alarm system and window covering assembly includes a top housing, a bottom rail, a covering, a continuous conductive wire which has a first end and a second end and an alarm device. The alarm device has a first input terminal and a second input terminal. The covering is mechanically coupled to the top housing and the bottom rail. The continuous conductive wire extends from the top housing down to the bottom rail and up from the bottom rail to the top housing. The first and second ends of said continuous conductive wire are electrically coupled to the first and second input terminals of the alarm system. The continuous conductive wire is coupled with the bottom rail as a main pull string for raising and lowering the bottom rail and the covering.

8 Claims, 8 Drawing Sheets

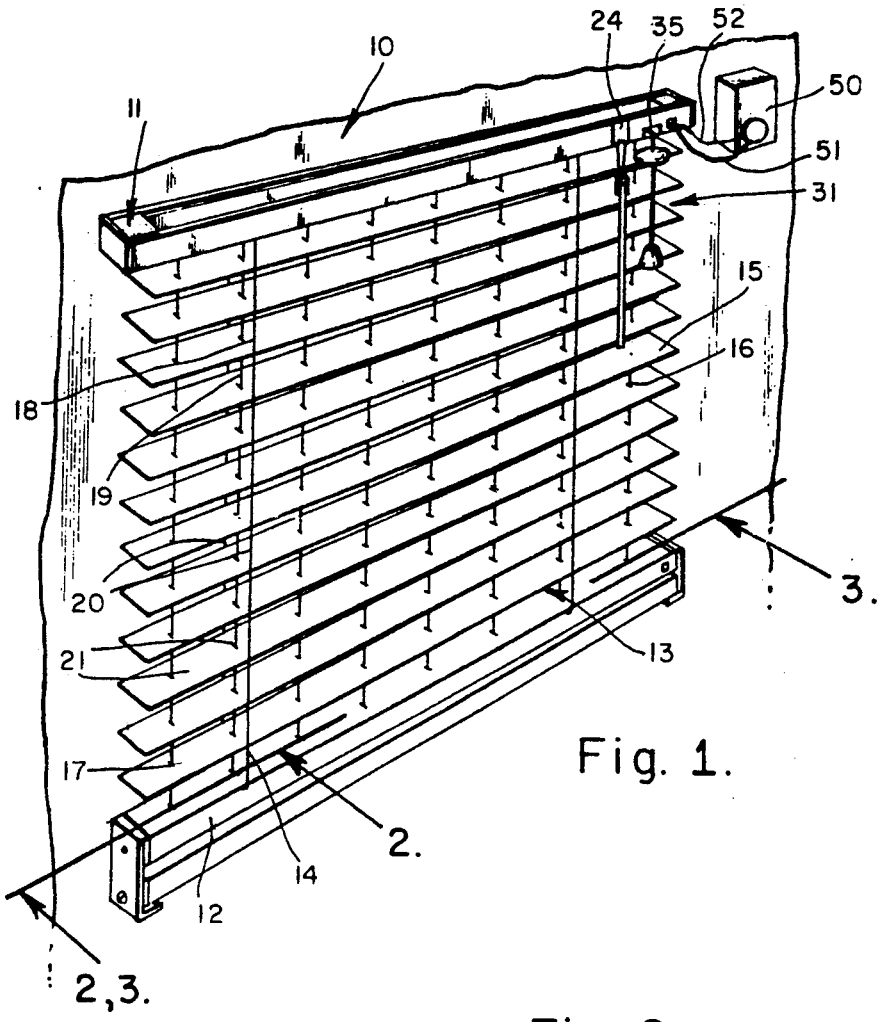
Fig. 1.
Fig. 2.
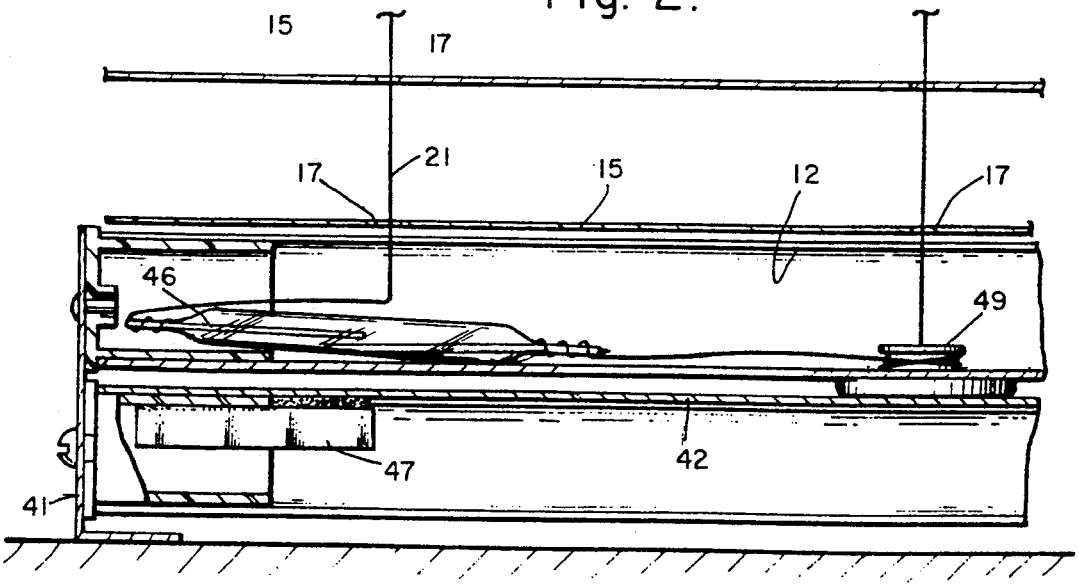

to Alarm
to Spool
11
12
13
14
15
16
17
21
22
23
24
25
31
32
33
34
36
37
38
41
42
43
46
47
48
49
50
1
2
3
4
5
6
7
8

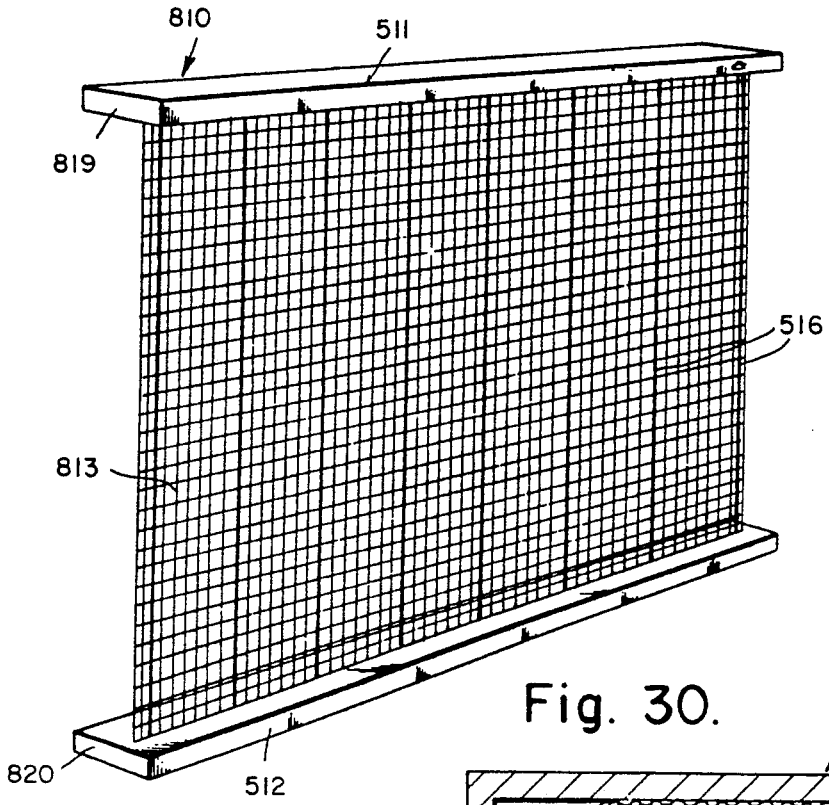
Fig. 30.
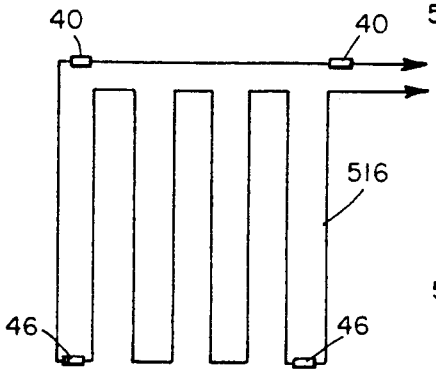
Fig. 32.
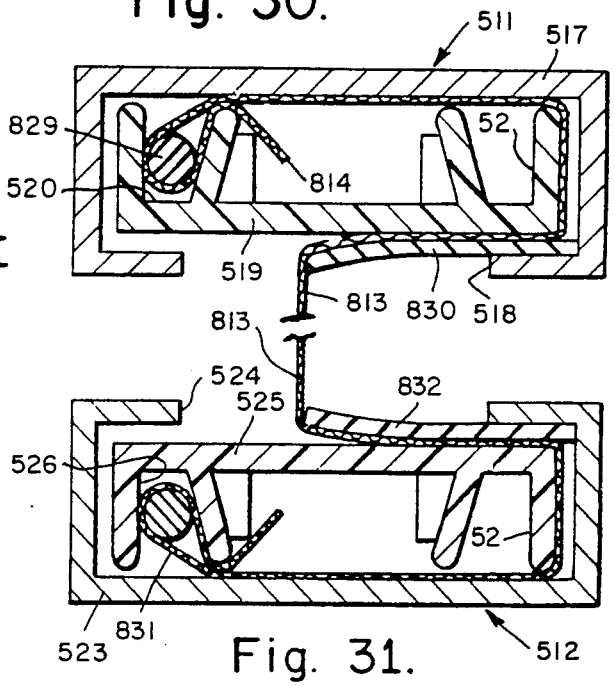
Fig. 31.
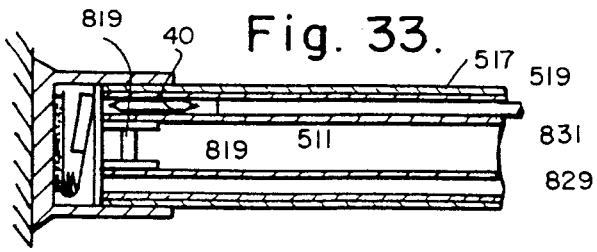
Fig. 33.
Fig. 34.
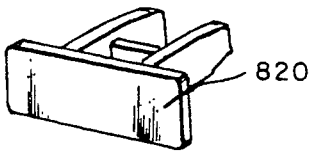

COMBINED ALARM SYSTEM AND WINDOW COVERING ASSEMBLY

BACKGROUND OF THE INVENTION

1. Field of the Invention

The field of the invention is combined alarm systems and window covering assemblies.

2. Description of the Prior Art

There are a number of combined alarm systems and window covering assemblies which have been proposed. These combined alarm systems and window covering assemblies include a mesh-wire screen which actuates an alarm device if the screen is cut or shorted or subjected to a physical force, a blind assembly which has a taut trip element which sets off an alarm device if the blind assembly is moved, a window grille which defines an electrical capacitance field which is distorted to set off an alarm device upon the physical deformation of the window grille by an attempted intrusion, a combined alarm system and roller-blind assembly which, when raised, actuates an alarm device and various types of other mechanical or magnetic switching arrangements which are actuated to set off an alarm device when an unauthorized attempt is made to open either a barrier or a window. In general, however, the known combined alarm systems and window covering assemblies are not entirely satisfactory for one or more of the following reasons. Some of these combined alarm systems and window covering assemblies do not provide for convenient arrangements for opening the barrier and disabling the alarm device by an authorized user. Other combined alarm systems and window covering assemblies are of complicated and therefore expensive constructions. Most combined alarm systems and window covering assemblies are of unpleasant external appearance.

U.S. Pat. No. 4,940,070 teaches a blind assembly in which a string ladder support system on each side supports the individual slats. A main pull string at each ladder support system extends down through holes in each slat to a bottom rail where it is attached. The main pull string goes through the top housing and down over a roller so that the main pull string can raise and lower the blind assembly. U.S. Pat. No. 4,487,243 teaches a blind assembly which has a lift cord lock. U.S. Pat. No. 4,945,970 teaches a cord lock unit for use in a blind assembly. U.S. Pat. No. 4,660,612 teaches a cord lock for a blind assembly. U.S. Pat. No. 4,802,644 teaches a bracket which releasably secures a channel section head-rail of blind assembly to a wall. U.S. Pat. No. 4,363,459 teaches a bracket for use with a blind assembly. U.S. Pat. No. 4,623,012 teaches a capstan based system for pulling and accumulating the pull-cords which is used to lift hanging window coverings from their bottoms. U.S. Pat. No. 4,722,383 teaches a cord lock for locking a blind assembly in its raised position only. U.S. Pat. No. 5,002,113 teaches a blind assembly. U.S. Pat. No. 4,476,909 teaches a cord lock for a blind assembly. U.S. Pat. No. 4,541,468 teaches a tilting mechanism. U.S. Pat. No. 4,386,644 teaches a first tilting mechanism which includes a tilt rod, a cap which is mounted to one end of the head and which includes a bushing, a sleeve which is connected to the tilt rod and which is rotatably supported in the bushing, and a worm gear which is located within the cap and which is connected to the sleeve, and a worm on a shaft which is accessible from outside the cap and which is operatively connected to the worm gear for rotating the worm gear by means of a wand. U.S. Pat. No. 4,386,644 also teaches a second tilting mechanism which includes a sprocket wheel and a bead chain. U.S. Pat. No. 4,621,673 teaches a tilting mechanism for a blind assembly.

U.S. Pat. No. 4,281,320 teaches a combined alarm system and blind assembly which includes a plurality of slats which may be compacted to open the combined alarm system and blind assembly. The slats are supported by flexible cords which include electrical conductors establishing an electrically-conductive pathway through the length of the window blind. The lower end of the combined alarm system and blind assembly carries a retaining mechanism which retains the combined blind assembly and burglar alarm in its closed position. A circuit-interrupting mechanism is effective when the combined alarm system and blind assembly is raised or severed to actuate an alarm device. The retaining mechanism and the circuit interrupting mechanism include magnetic retainer elements which are adapted to actuate magnetic reed switches which are carried at the lower ends of the combined alarm system and blind assembly.

U.S. Pat. No. 4,160,972 teaches a combined alarm system and blind assembly which includes a magnetic reed switch which is normally open and which is mounted on the bottom of a bottom railing. A magnet is mounted in a window sill to hold the magnetic reed switch normally closed when the combined alarm system and blind assembly is in its normal position. When the magnetic reed switch moves away from the magnet the magnetic reed switch opens.

U.S. Pat. No. 4,582,109 teaches an accordion fold type decorative fabric drapery system which has a pair of drapery sections of decorative weave fabric sheets specially formed into sharply pleated accordion-like folds to provide a large number of vertically elongated narrow panels resembling in size the slats or louvers of a vertical blind system. U.S. Pat. No. 4,677,013 teaches a honeycomb structure which is formed of a continuous length of foldable material which is folded into a Z-configuration and which is stacked in layers which are adhered together. These layers form longitudinally extending cells, one on top of the other, of the honeycomb structure. U.S. Pat. No. 4,861,404 teaches a honeycomb product. U.S. Pat. No. 4,687,039 teaches a pleated shade in which there is a vacuum deposited aluminized surface. The first and second pleated sheets are arranged so that the corresponding aluminized surfaces face one another within the second pleated shade so that the second pleated shade has a significant resistance to heat loss or gain, if properly installed, and is decorative and distinctive in appearance. U.S. Pat. No. 4,982,776 and U.S. Pat. No. 4,913,210 teach a cord lock for a pleated shade. U.S. Pat. No. 4,974,656 teaches a pleated shade. U.S. Pat. No. 4,913,210 teaches a cord lock for a pleated shade.

U.S. Pat. No. 4,999,608 teaches an electrically conductive security screen which includes an electrical resistance sensor and alarm to detect tampering with the screening material of a window. An elongated path of flexible and electrically conductive coating composition is applied to the screening material in a predetermined and non-overlapping pattern, such that a closed circuit loop is formed when it is attached to the sensor alarm. The coating has an electrical resistance that varies when it is distorted or its path interrupted.

U.S. Pat. No. 4,839,632 teaches a combined alarm system and screen assembly which has mounting brackets at the corners and a pair of substantially rigid opposite end piece assemblies on which a screen mesh can be rolled up. At each corner a circuit closing mechanism acts between the bracket there and the adjacent end piece assembly to close circuit of an alarm device through electrical wiring in the screen only when that end piece assembly is held by the bracket.

U.S. Pat. No. 4,146,293 teaches a combined alarm system and screen assembly includes a frame and a screen mesh. The combined alarm system and screen assembly includes a continuous conductive wire which may be sewn, glued or interwoven onto the screen mesh in order to fix it in place and which provide a series circuit. U.S. Pat. No. 4,232,310, U.S. Pat. No. 4,843,375, U.S. Pat. No. 3,051,935 and U.S. Pat. No. 5,005,000 all teach combined alarm system and screen assemblies in which the continuous conductive wire may be interwoven, glued by an air hardening process and/or sewn onto the screen mesh.

U.S. Pat. No. 4,843,375 teaches a combined alarm system and roll-up screen assembly which is for use in a frame and which includes a roll-up mechanism, a screen mesh and a continuous conductive wire.

U.S. Pat. No. 4,234,875 teaches a security panel arrangement,for use with an intrusion alarm system which is designed to monitor the continuity of a normally continuous signal conductive path and to produce a warning signal when the signal conductive path is broken, which arrangement includes a cellular panel forming a series of parallel elongated passages through which extends at least one means for conducting a signal. The cellular panel is attached to a surface portion of a structure to be secured, and the means for conducting a signal is connected at its two ends to the alarm system in a continuity monitoring relationship therewith. Passage of a human being through the surface portion breaks the continuity of the means for conducting a signal and causes the alarm system to produce the warning signal.

U.S. Pat. No. 4,275,294 teaches a security system and strip or strand which incorporates an optical fiber wave-guide. To provide security against unauthorised crossing of a boundary, at least one optical fiber wave-guide extends along the boundary. Light is directed into one end of the optical fiber wave-guide and the light leaving the optical fiber wave-guide is detected by an optical detector. An indication is given when the optical intensity of the detected light falls below a predetermined threshold, so as to warn when the optical fiber wave-guide is disturbed significantly or cut through.

U.S. Pat. No. 4,367,460 teaches a transparent continuous optical fiber which is embedded in a transparent panel made of glass or plastic, with the two ends of the optical fiber accessible from outside the panel for coupling to a visible or invisible light source and detector respectively. By nearly matching the refractive indices of the panel and the optical fiber, and using good-quality material for the fiber so that it does not scatter significant amounts of the light passing through it, the optical fiber can be made virtually invisible although it establishes a complete light circuit. Cutting or breaking through the panel at a point intersecting the optical fiber interrupts the light circuit and triggers an alarm.

SUMMARY OF THE INVENTION

The present invention is directed to a combined alarm system and window covering assembly which is visually identical to a window covering assembly having a bottom rail and a covering and in which a continuous conductive wire is coupled with a bottom rail as a main pull string for raising and lowering the bottom rail and the covering.

In another aspect of the present invention, a combined alarm system and window covering assembly which is visually identical to a window covering assembly having a bottom rail and a covering and in which a continuous optical fiber is coupled with a bottom rail as a main pull string for raising and lowering the bottom rail and the covering.

In still another aspect of the present invention, a combined alarm system and screen assembly which is visually identical to a screen assembly having a bottom rail and a screen mesh and in which a continuous conductive wire is a single integral length of conductive wire in which none of its first and second pluralities of parallel segments have been spliced together.

In yet another aspect of the present invention, a combined alarm system and screen assembly which is visually identical to a screen assembly having a bottom rail and a screen mesh and in which a continuous optical fiber is a single integral length of optical fiber in which none of its first and second pluralities of parallel segments have been spliced together.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 1 is a perspective view of a first combined alarm system and blind assembly which includes a first top housing assembly, a first bottom assembly, including a first bottom rail and a second bottom rail, and a continuous length of conductive wire and which has been constructed in accordance with the principles of the first embodiment.

FIG. 2 is a partial elevational view in cross-section of the first combined alarm system and blind assembly of FIG. 1 taken along line 2—2 of FIG. 1.

FIG. 30 is a perspective view of a first combined alarm system and screen assembly which includes a third top housing assembly, a third bottom housing assembly, a screen mesh and a continuous conductive wire and which has been constructed in accordance with the principles of the tenth embodiment.

FIG. 31 is a partial side elevational view in cross-section of the first bottom bracket assemblies of the first combined alarm system and screen assembly of FIG. 30.

FIG. 32 is a schematic diagram of the continuous length of conductive wire of the first combined alarm system and screen assembly of FIG. 30.

FIG. 33 is a side elevational view in cross-section of the third bottom housing assembly of the first combined alarm system and screen assembly of FIG. 30 after it has been inserted into a first bottom bracket assembly thereof.

FIG. 34 is a perspective view of one of two caps of each of the third top and bottom housing assemblies.

DESCRIPTION OF THE PREFERRED EMBODIMENT

Figures 3, 4:
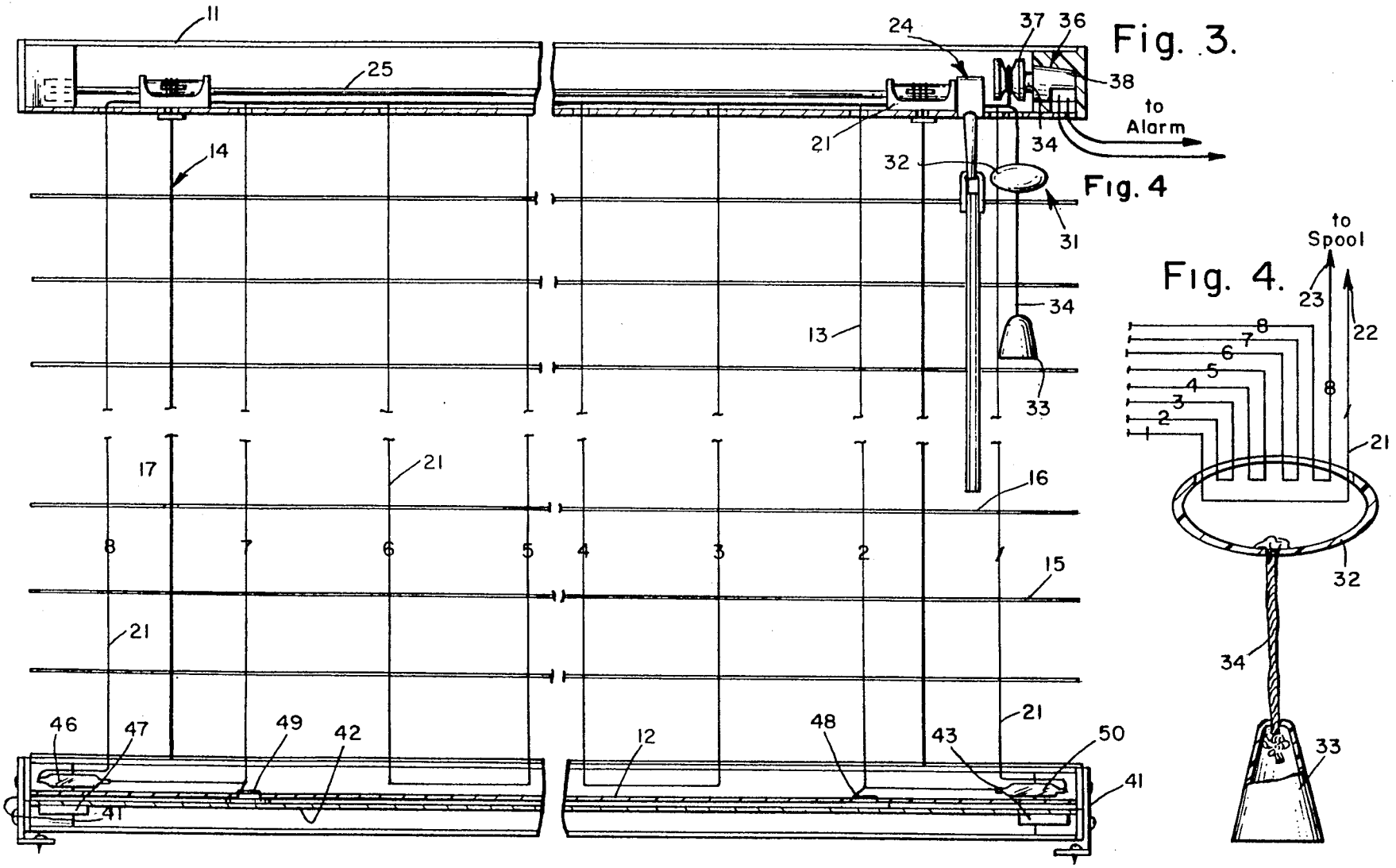
FIG. 3 is an elevational view in cross-section of the first combined alarm system and blind assembly of FIG. 1 taken along line 3—3 of FIG. 1.
FIG. 4 is a schematic diagram of the continuous length of conductive wire of the first combined alarm system and blind assembly of FIG. 1.

Referring to FIG. 1 in conjunction with FIG. 2, FIG. 3 and FIG. 4 a first combined alarm system and blind assembly 10 includes a first top housing assembly 11, a first bottom housing including a first bottom rail 12, a first string ladder support system 13, a second string ladder support system 14 and a plurality of individual slats 15. Each slat 15 has a first slot 16 and a second slot 17 which is spaced apart from the first slot 16. Each of the first and second string ladder support systems 13 and 14 has a front vertical ladder string 18 and a back vertical ladder string 19 with short support strings 20 fastened between the front and back vertical ladder strings 18 and 19. The first and second string ladder support systems 13 and 14 are mechanically coupled to the first top housing assembly 11 and the first bottom rail 12. Each of the short support strings 20 of the first and second string ladder support systems 13 and 14 supports one of the individual slats 15 contiguous to the first and second slots 16 and 17, respectively, thereof. A continuous conductive wire 21 has a first end and a second end and extends from the first top housing assembly 11 down through each of the first slots 16 of the slats 15 to the first bottom rail 12 and from the first bottom rail 12 up through each of the second slots 17 of the slats 15 to the first top housing assembly 11. The first top housing assembly 11 has a tilting mechanism 24 and a tilt rod 25 which is disposed in the first top housing assembly 11 and mechanically coupled thereto and which is fixedly coupled to the first and second string ladder support systems 13 and 14.

Referring to FIG. 3 in conjunction with FIG. 1 and FIG. 4 portions of the continuous conductive wire 21 form part of a pull string assembly 31 for raising and lowering the first combined alarm and blind assembly 10. The first pull string assembly 31 includes a capsule member 32, a pull tab 33, a cord 34, a cord lock unit 35 and a winding mechanism 36. The cord 34 mechanically couples the pull tab 33 to the capsule 32. The cord lock unit 35 and the winding mechanism 36 are disposed in the first top housing assembly 11 and mechanically coupled thereto. The first and second ends 22 and 23 of the continuous conductive wire 21 are threaded through the cord lock unit 35 and the first top housing assembly 11 into the capsule member 32. The cord lock unit 35 locks the continuous conductive wire 21 in place. The winding mechanism 36 includes a spool 37, a rotating connector 38 having a shaft 39 to which the spool 37 is fixedly coupled and to which the first and second ends of the continuous conductive wire 21 are electrically coupled. The winding mechanism 36 winds and unwinds lengths of the continuous conductive wire 21 which become slack when the first pull string assembly 31 raises the first combined alarm system and blind assembly 10.

Referring to FIG. 3 in conjunction with FIG. 1 and FIG. 2 the first combined alarm system and blind assembly 10 also includes a first magnetic reed relay switch 40, two bottom brackets 41, a second bottom rail 42 and a first magnet 43. The two bottom brackets 41 mechanically couple the ends of the second bottom rail 42 to the bottom portion of a structure. The first combined alarm system and blind assembly 10 further includes two top brackets, a second magnetic reed relay switch 46, a second magnet 47, a first wire-anchor 48 and a second wire-anchor 49. The two top brackets mechanically couple the ends of the first top housing assembly 11 to the top portion of the structure. The first and second magnetic reed relay switches 40 and 46, respectively, are disposed in the first bottom rail 12 adjacent to the first and second magnets 43 and 47. The first and second magnets 43 and 47 are disposed in the second bottom rail 42 adjacent to each end thereof. The first and second magnetic reed relay switch 40 and 46 electrically couple the severed portions of the continuous conductive wire 21 back together in the presence of the first and second magnets 43 and 47. The first and second wire-anchor 48 and 49 are disposed in the first bottom rail 12 and mechanically coupled thereto so that the first and second wire-anchor 48 and 49 support the portions of the continuous conductive wire 21 adjacent to the first and second magnetic reed relay switch 40 and 46, respectively. The continuous conductive wire 21 makes a plurality of round-trips each of which extends from the first top housing assembly 11 down through each of the first slots 16 of the slats 15 to the first bottom rail 12 and from the first bottom rail 12 up through each of the second slots 17 of the slats 15 to the first top housing assembly 11.

Referring to FIG. 3 in conjunction with FIG. 1 and FIG. 4 an alarm device 50 has a first input terminal 51 and a second input terminal 52. The first and second ends of the continuous conductive wire 21 are electrically coupled to the first and second input terminals 51 and 52, respectively, of the alarm device 50 through the rotating connector 38.

Figure 5:
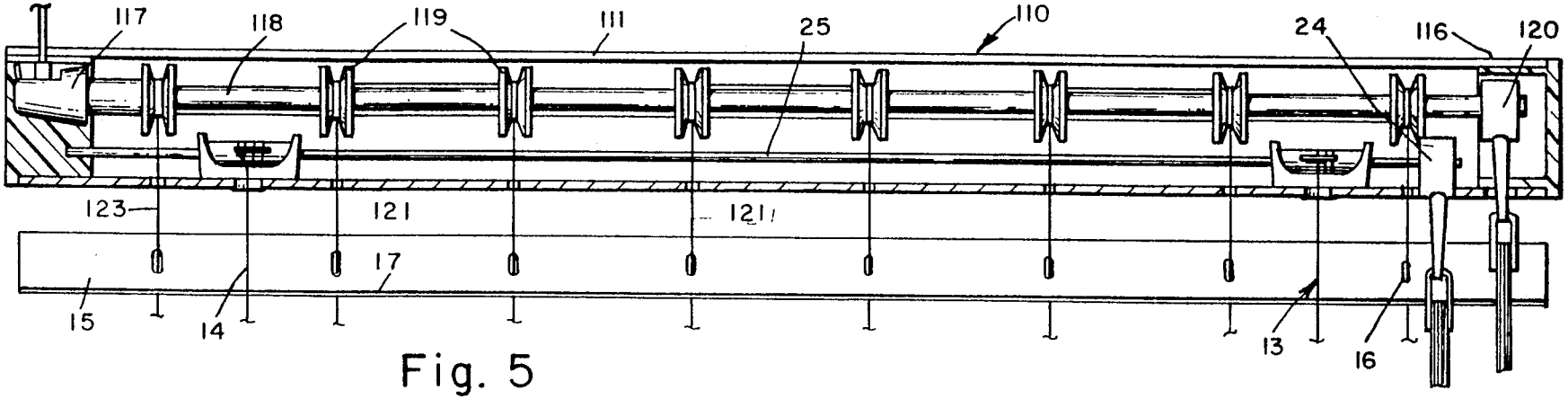
FIG. 5 is an elevational view in cross-section of a second combined alarm system and blind assembly which includes a second top housing assembly and a first lifting mechanism including a first shaft, a plurality of first spools and a plurality of vertically disposed continuous lengths of conductive wire and which has been constructed in accordance with the principles of the second embodiment.
Figure 9:
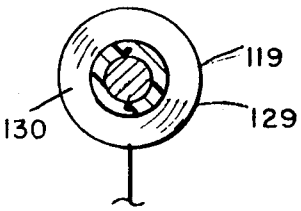
FIG. 9 is a second transverse cross-sectional view of the first shaft and one of the first spools of FIG. 5 taken along line 9—9 of FIG. 7.
Figure 8:
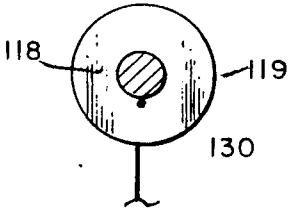
FIG. 8 is a first transverse cross-sectional view of the first shaft and one of the first spools of FIG. 5 taken along line 8—8 of FIG. 7.
Figure 7:
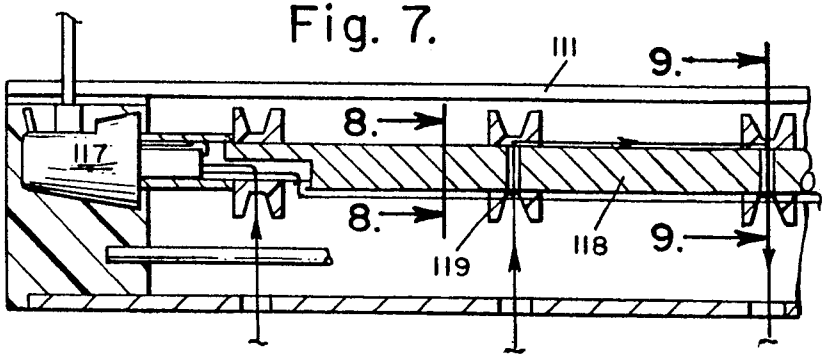
FIG. 7 is a partial elevational view in cross-section of the first lifting mechanism of FIG. 5.
Figure 6:
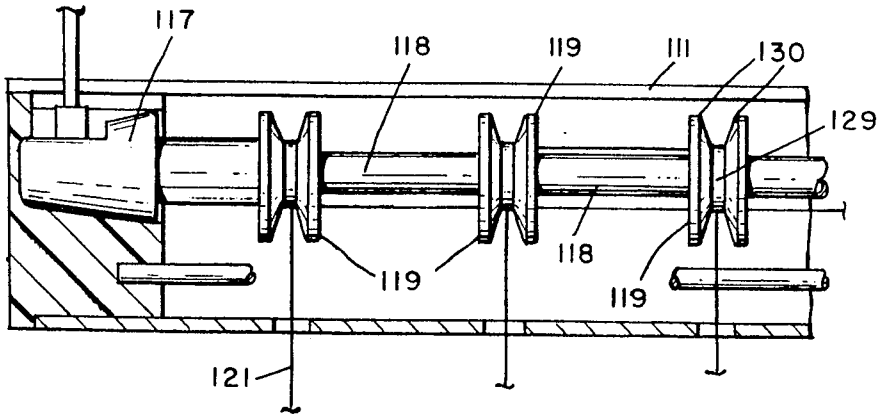
FIG. 6 is a partial elevational view of the first lifting mechanism of FIG. 5.

Referring to FIG. 5 in conjunction with FIG. 3 and FIG. 6 a second combined alarm system and blind assembly 110 includes a second top housing assembly 111, the first bottom housing assembly including the first bottom rail 12, the first string ladder support system 13, the second string ladder support system 14, the plurality of individual slats 15, the tilting mechanism 24, the tilt rod 25 and a first lifting assembly 116, the first magnetic reed relay switch 40 and the second magnetic reed relay switch 46. Each slat 15 has a first slot 16 and a second slot 17 which is spaced apart from the first slot 16. The tilting mechanism 24 is disposed in the second top housing assembly 111 and mechanically coupled thereto. The tilting mechanism 24 is mounted to one end of the second top housing assembly 111. The tilting mechanism 24 is connected to the tilt rod 25. The tilt rod 25 is fixedly coupled to the first and second string ladder support systems 13 and 14. The first and second magnetic reed relay switches 40 and 46 are disposed in the first bottom rail 12.

Referring to FIG. 5 in conjunction with FIG. 6, FIG. 7, FIG. 8 and FIG. 9 the first lifting assembly 116 includes a rotating connector 117, a first shaft 118, a plurality of first spools 119 and a first winding mechanism 120. The first shaft 118 is a solid rod which is disposed in the second top housing assembly 111 and which is rotatively coupled to the rotating connector 117. Each first spool 119 is disposed in the second top housing assembly ill and is fixedly coupled to the first shaft 118. The first winding mechanism 120 is disposed in the second top housing assembly 111 and is rotatively coupled to the first shaft 118. The first lifting assembly 116 also includes a conductive wire 121 including a first vertically disposed continuous length, a second vertically disposed continuous length, a first horizontally disposed continuous length, a first plurality of horizontally disposed continuous length. The first vertically disposed continuous length of conductive wire 121 has a first end and a second end. The second vertically disposed continuous length of conductive wire 121 has a first end and a second end. Each first spool 119 has a sleeve 129 which is fixedly coupled to the first shaft 118 and two side panels 130 each of which has a first horizontal bore and a second horizontal bore. The first and second ends of the first vertically disposed continuous length of conductive wire 121 are mechanically and electrically coupled to one of the first spools 119 and the first magnetic reed relay switch 40, respectively. The first vertically disposed continuous length of conductive wire 121 extends from one of the first spools 119 in the second top housing assembly 111 down through each of the first slots 16 of the slats 15 to the first bottom rail 12. The first and second ends of the second vertically disposed continuous length of conductive wire 121 are mechanically and electrically coupled to another first spool 119 and the second magnetic reed relay switch 46, respectively. The second vertically disposed continuous length of conductive wire 121 extends from the first bottom rail 12 up through each of the second slots 17 of the slats 15 to the other first spool 119 in the second top housing assembly 111. The first and second magnetic reed relay switch 40 and 46 electrically couple severed portions of the first and second vertically disposed continuous lengths of conductive wire 121 back together in the presence of a first magnet 43 and a second magnet 47, respectively. The first and second vertically disposed continuous lengths of conductive wire 121 make a plurality of round-trips each of which extends from the second top housing assembly 111 down through each of the first slots 16 of the slats 15 to the first bottom rail 12 and from the first bottom rail 12 up through each of the second slots 17 of the slats 15 to the second top housing assembly 111. The first winding mechanism 120 winds and unwinds the first and second vertically disposed continuous lengths of conductive wire 121 which otherwise would become slack when the first lifting assembly 116 raises the second combined alarm system and blind assembly 110.

Figure 10:
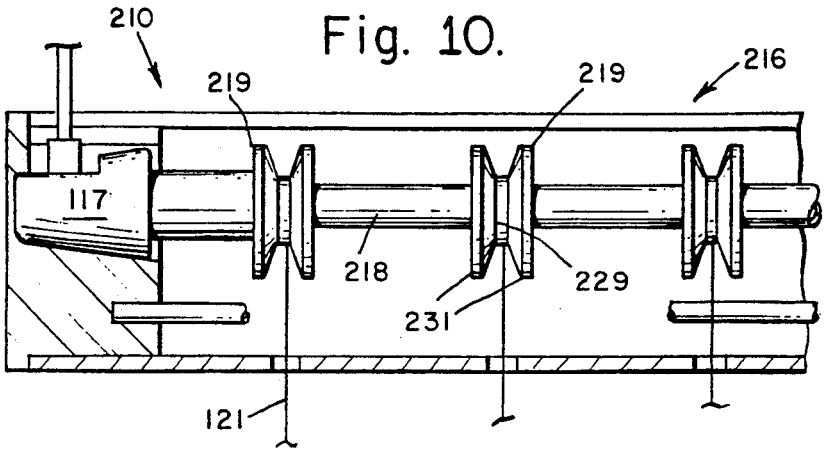
FIG. 10 is a partial elevational view of a third combined alarm system and blind assembly which includes a second top housing and a second lifting mechanism including a second shaft, a plurality of second spools and a plurality of vertically disposed continuous lengths of conductive wire and which has been constructed in accordance with the principles of the third embodiment.
Figure 12:
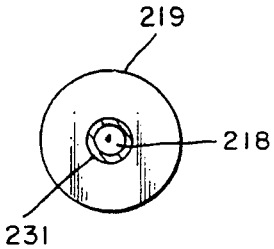
FIG. 12 is a first transverse cross-sectional view of the second shaft and one of the second spools of FIG. 10 taken along line 12—12 of FIG. 11.

Referring to FIG. 5 in conjunction with FIG. 3 and FIG. 10 a third combined alarm system and blind assembly 210 includes the second top housing assembly ill, the first bottom housing assembly including the first bottom rail 12, the first string ladder support system 13, the second string ladder support system 14, the plurality of individual slats 15, the tilting mechanism 24, the tilt rod 25 and a second lifting assembly 216, the first magnetic reed relay switch 40 and the second magnetic reed relay switch 46.

Referring to FIG. 5 in conjunction with FIG. 10, FIG. 11, FIG. 12 and FIG. 13 the second lifting assembly 216 includes the rotating connector 117, a second shaft 218, a plurality of second spools 219 and the first winding mechanism 120. The second shaft 218 is a hollow cylinder which is disposed in the second top housing assembly 111 and which is rotatively coupled to the rotating connector 117. Each second spool 219 is disposed in the second top housing assembly 111 and is fixedly coupled to the second shaft 218. The first winding mechanism 120 is disposed in the second top housing assembly 111 and is rotatively coupled to the second shaft 218. The second lifting assembly 216 also includes the first continuous vertically disposed length of conductive wire 121, the second vertically disposed continuous length of conductive wire 121, the first horizontally disposed continuous length of conductive wire 121, the first plurality of horizontally disposed continuous length of conductive wire 121. The first vertically disposed continuous length of conductive wire 121 has a first end and a second end. Each second spool 219 has a sleeve 229 which has a transverse bore 230 and which is fixedly coupled to the second shaft 218 and two side panels 231. The first and second ends and of the first vertically disposed continuous length of conductive wire 121 are mechanically and electrically coupled to one of the second spools 219 and the first magnetic reed relay switch 40, respectively. The first vertically disposed continuous length of conductive wire 121 extends from one of the second spools 219 in the second top housing assembly 111 down through each of the first slots 16 of the slats 15 to the first bottom rail 12. The first and second ends of the second vertically disposed continuous length of conductive wire 121 are mechanically and electrically coupled to another second spool 219 and the second magnetic reed relay switch 46, respectively. The second vertically disposed continuous length of conductive wire 121 extends from the first bottom rail 12 up through each of the second slots 17 of the slats 15 to the other second spool 219 in the second top housing assembly ill. The first and second magnetic reed relay switch 40 and 46 electrically couple severed portions of the first and second vertically disposed continuous lengths of conductive wire 121 back together in the presence of a first magnet 43 and a second magnet 47, respectively. The first winding mechanism 120 winds and unwinds the first and second vertically disposed continuous lengths of conductive wire 121 which otherwise would become slack when the second lifting assembly 216 raises the third combined alarm system and blind assembly 210.

Figure 14:
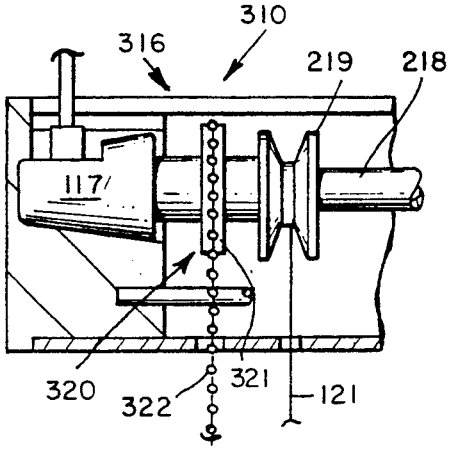
FIG. 14 is a partial elevational view of a fourth combined alarm system and blind assembly which includes a second top housing and a third lifting mechanism including a second shaft, a plurality of second spools, a plurality of vertically disposed continuous lengths of conductive wire and which has been constructed in accordance with the principles of the fourth embodiment.
Figure 13:
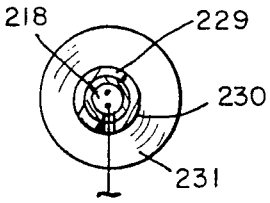
FIG. 13 is a second transverse cross-sectional view of the second shaft and one of the second spools of FIG. 10 taken along line 13—13 of FIG. 11.
Figure 11:
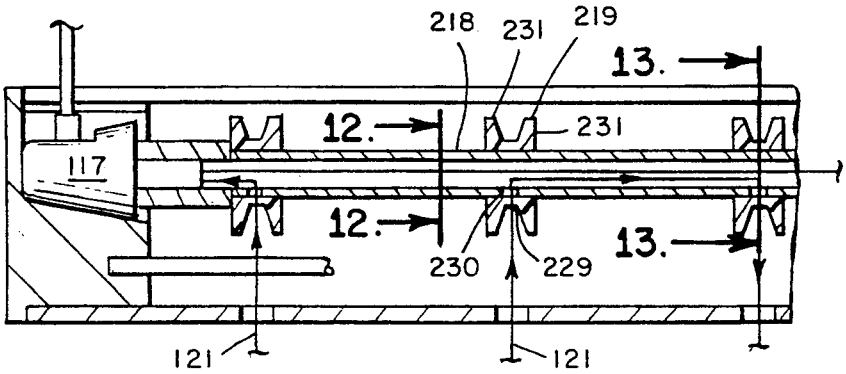
FIG. 11 is a partial elevational view in cross-section of the second lifting mechanism of FIG. 10.

Referring to FIG. 5 in conjunction with FIG. 3 and FIG. 14 a fourth combined alarm system and blind assembly 310 includes the second top housing assembly 111, the first bottom housing assembly including the first bottom rail 12, the first string ladder support system 13, the second string ladder support system 14, the plurality of individual slats 15, the tilting mechanism 24, the tilt rod 25 and a third lifting assembly 316, the first magnetic reed relay switch 40 and the second magnetic reed relay switch 46. The tilting mechanism 24 is mounted to one end of the second top housing assembly ill. The tilting mechanism 24 is connected to the tilt rod 25.

Referring to FIG. 5 in conjunction with FIG. 14 the third lifting assembly 316 includes the rotating connector 117, the second shaft 218, the plurality of second spools 219 and a second winding mechanism 320. The second shaft 218 is a hollow cylinder which is disposed in the second top housing assembly 111 and which is rotatively coupled to the rotating connector 117. Each second spool 219 is disposed in the second top housing assembly 111 and is fixedly coupled to the second shaft 218. The second winding mechanism 320 is disposed in the second top housing assembly 111 and is rotatively coupled to the second shaft 218. The third lifting assembly 316 also includes the first continuous vertically disposed length of conductive wire 121, the second vertically disposed continuous length of conductive wire 121, the first horizontally disposed continuous length of conductive wire 121, the first plurality of horizontally disposed continuous length of conductive wire 121. The second winding mechanism 320 includes a sprocket wheel 321 and a bead chain 322. The sprocket wheel 321 is connected to the second shaft 218. The bead chain 322 which is located within the second winding mechanism 320 passes over the sprocket wheel 321 for rotating the sprocket wheel 321.

Figure 15:
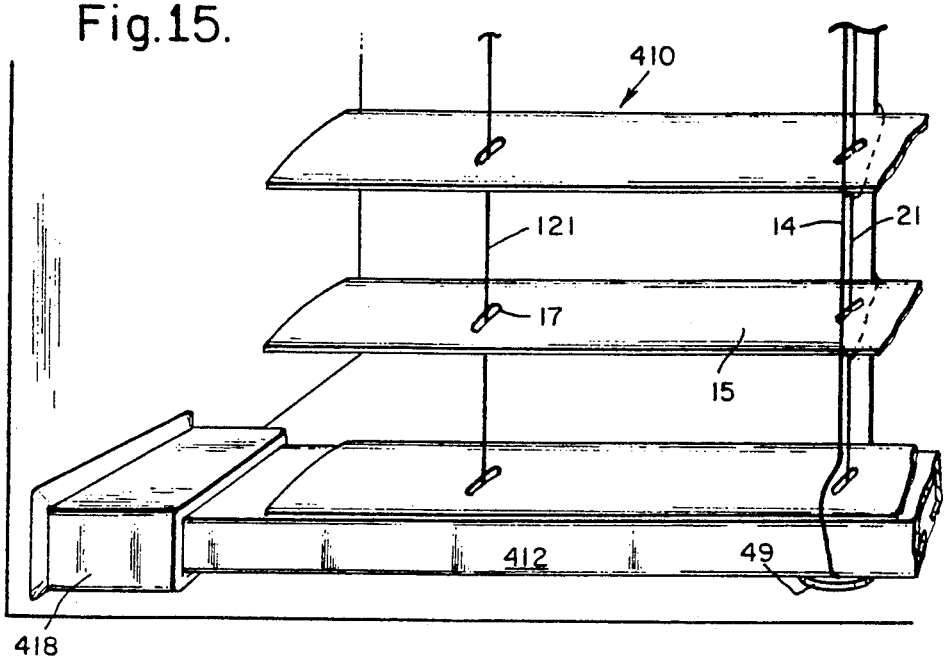
FIG. 15 is a partial perspective view of a fifth combined alarm system and blind assembly which includes a second top assembly, a second bottom housing assembly, four magnetic reed relay switches, two first top bracket assemblies, two first bottom bracket assemblies, four magnets and a continuous length of conductive wire and which has been constructed in accordance with the principles of the fifth embodiment.
Figure 16:
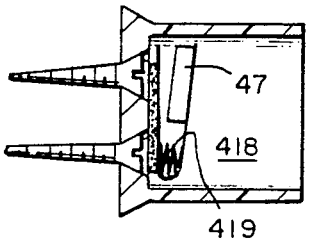
FIG. 16 is a side elevational view in cross-section of one of the two first bottom bracket assemblies, each of which includes a spring on which one of the four magnets is mounted, of the fifth combined alarm system and blind assembly of FIG. 15 in which the spring is compressed.
Figure 17:
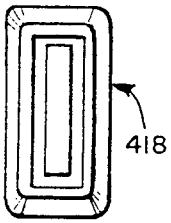
FIG. 17 is an end view of one of the two first bottom bracket assemblies and one of the four magnets of the fifth combined alarm system and blind assembly of FIG. 15.

Referring to FIG. 15 in conjunction with FIG. 3, FIG. 16 and FIG. 17 a fifth combined alarm system and blind assembly 410 includes the second top housing assembly 111, a second bottom assembly 412, the first string ladder support system 13, the second string ladder support system 14, the plurality of individual slats 15, the tilting mechanism 24, the tilt rod 25 and a third lifting assembly 316, two first bottom bracket assemblies 418, the first magnetic reed relay switch 40 and the second magnetic reed relay switch 46.

Figure 18:
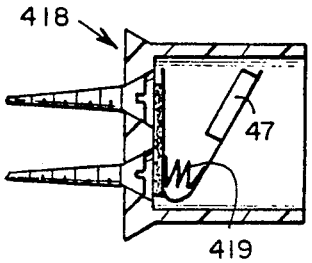
FIG. 18 is a side elevational view in cross-section of one of the two first bottom bracket assemblies, each of which includes a spring on which one of the four magnets is mounted, of the fifth combined alarm system and blind assembly of FIG. 15 in which the spring is not compressed.

Referring to FIG. 15 in conjunction with FIG. 16, FIG. 17 and FIG. 18 each of the two first bottom bracket assemblies 418 includes a spring 419 on which one of the first and second magnets 43 and 47 is mounted. The spring 419 may be either compressed or not compressed.

Figure 19:
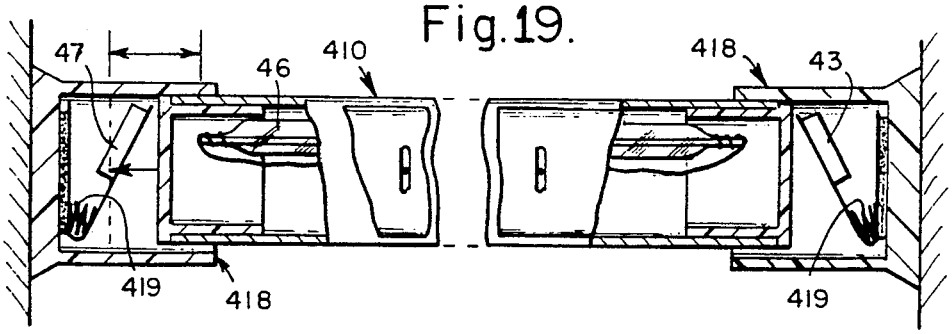
FIG. 19 is a fragmented side elevational view in cross-section of the second bottom housing assembly, the two first bottom bracket assemblies and two of the four magnets of the fifth combined alarm system and blind assembly of FIG. 15 as the second bottom housing assembly is being inserted into two first bottom bracket assemblies.
Figure 20:
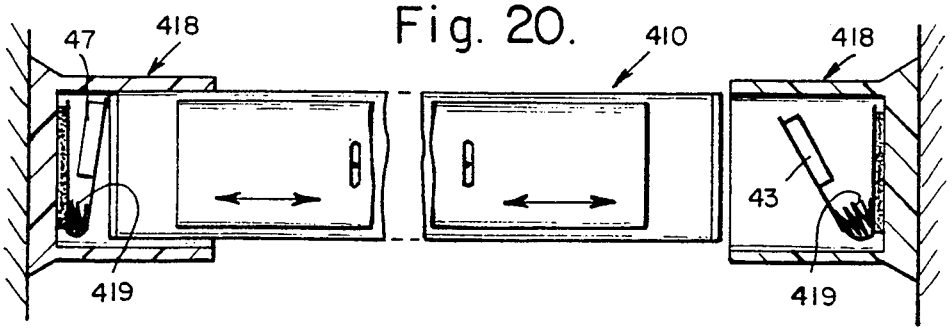
FIG. 20 is a fragmented side elevational view in cross-section of the second bottom housing assembly, the two first bottom bracket assemblies and two of the four magnets of the fifth combined alarm system and blind assembly of FIG. 15 as the second bottom housing assembly has been inserted into one of the two first bottom bracket assemblies.

Referring to FIG. 15 in conjunction with FIG. 19 and FIG. 20 the second bottom housing assembly 412 is shown as it is being inserted into two first bottom bracket assemblies 418. The second bottom housing assembly 412 is then shown after it has been inserted into one of the two first bottom bracket assemblies 418.

Figure 21:
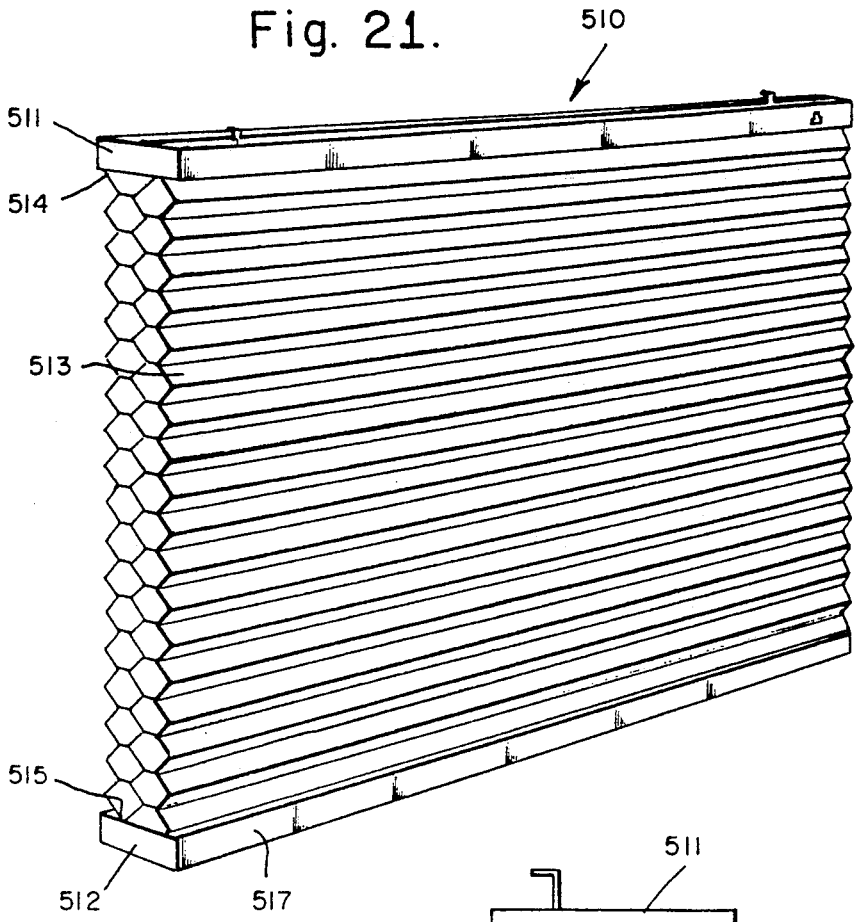
FIG. 21 is a perspective view of a first combined alarm system and shade assembly which includes a third top housing assembly, a third bottom housing assembly, a double honeycomb shade, four magnetic reed relay switches, a cord lock, two second top bracket assemblies, two second bottom bracket assemblies, four magnets and a continuous conductive wire and which has been constructed in accordance with the principles of the seventh embodiment.
Figure 21:
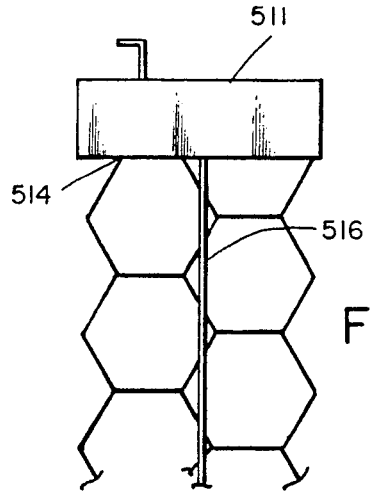
Figure 23:
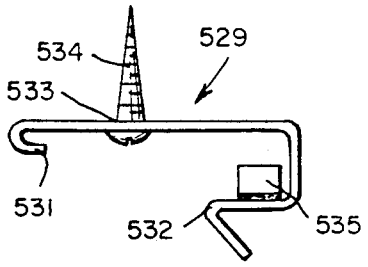
FIG. 23 is a side elevational view in partial cross-section of the seventh combined alarm system and shade assembly of FIG. 21.
Figure 22:
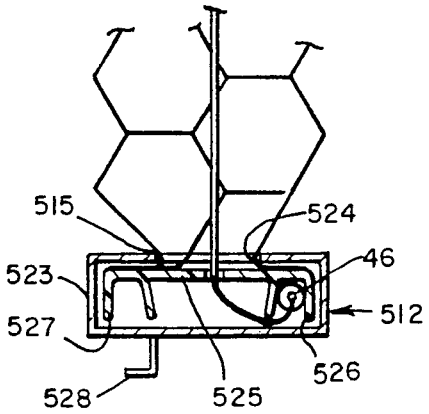
FIG. 22 is a side elevational view of one of the second top and bottom bracket assemblies and one of the four magnets of the seventh combined alarm system and shade assembly of FIG. 21.

Referring to FIG. 21 in conjunction with FIG. 22, FIG. 23, FIG. 26 and FIG. 30 a first combined alarm system and shade assembly 510 includes a third top housing assembly 511, a third bottom housing assembly 512, a double honeycomb shade 513 having a top edge 514 and a bottom edge 515, a continuous conductive wire 516, the first magnetic reed relay switch 40 and the second magnetic reed relay switch 46. U.S. Pat. No. 4,582,109, U.S. Pat. No. 4,677,013 and U.S. Pat. No. 4,861,404 teach single honeycomb structures which may be used to make the double honeycomb shade 513. The third top housing assembly 511 includes a first elongated, hollow rectangular member 517 with a slot 518 extending lengthwise along the bottom surface thereof, a first elongated rail 519 with a first channel 520 and a second channel 521 each of which extends lengthwise along the top inner surface thereof and two L-shaped flanges 522 each of which is mechanically coupled to the first elongated, hollow rectangular member 517 and disposed on the top outer surface thereof. One of the first magnetic reed relay switches 40 is disposed in the first channel 520 of the first elongated rail 519 at each end thereof. The double honeycomb shade 513 is mechanically coupled to the first elongated rail 519 adjacent to the first end 514 thereof. The first elongated rail 519 is slidably coupled to the first elongated, hollow rectangular member 517 so that the double honeycomb shade 513 extends through the slot 518 of the first elongated, hollow rectangular member 517. The third bottom housing assembly 512 includes a second elongated, hollow rectangular member 523 with a slot 524 extending lengthwise along the bottom surface thereof, a second elongated rail 525 with a first channel 526 and a second channel 527 each of which extends lengthwise along the bottom inner surface thereof, two L-shaped flanges 528 each of which is mechanically coupled to the second elongated, hollow rectangular member 523 and disposed on the bottom outer surface thereof. One of the second magnetic reed relay switches 46 is disposed in the first channel 526 of the second elongated rail 525 at each end thereof. The double honeycomb shade 513 is mechanically coupled to the second elongated rail 524 adjacent to the second end 515 thereof. The second elongated rail 525 is slidably coupled to the second elongated, hollow rectangular member 523 so that the double honeycomb shade 513 extends through the slot 524 of the second elongated, hollow rectangular member 523. The first combined alarm system and shade assembly 510 also includes two top bracket assemblies 529, two bottom bracket assemblies 530 and a cord lock 131. U.S. Pat. No. 4,982,776 and U.S. Pat. No. 4,913,210 teach cord locks. Each top bracket assembly 529 includes a first J-shaped member 531 with a first crook 532 and a first bore 533, a first mounting screw 534 and a first magnet 535. Each bottom bracket assembly 530 includes a second J-shaped member 536 with a second crook 537 and a second bore 538, a second mounting screw 539 and a second magnet 540. U.S. Pat. No. 4,363,459 teaches a bracket which includes a first J-shaped member with a first crook and a first bore and a first mounting screw. The continuous conductive wire 516 has a first end and a second end and extends from the third top housing assembly 511 down to the bottom housing assembly 512 and from the third bottom housing 512 to the top housing assembly 511. The first and second magnetic reed relay switch 40 and 46 electrically couple the severed portions of the continuous conductive wire 516 back together in the presence of the first and second magnets 535 and 540. The continuous conductive wire 516 makes a plurality of round-trips each of which extends from the third top housing assembly 511 down through the double honeycomb shade 513 to the third bottom housing assembly 512 and from the third bottom housing assembly 512 up through the double honeycomb shade 513 to the third top housing assembly 511.

Figure 24:
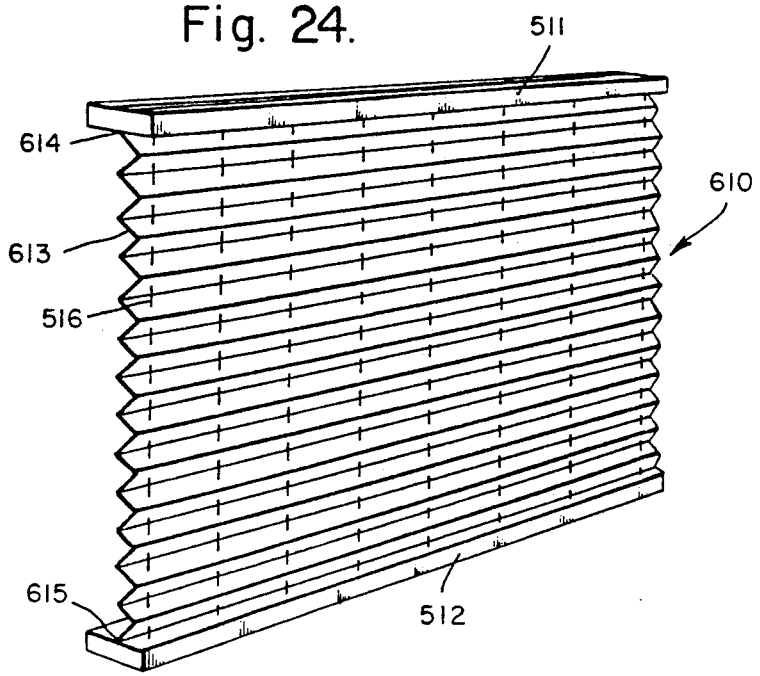
FIG. 24 is a perspective view of a second combined alarm system and shade assembly which includes a third top housing assembly, a third bottom housing assembly, a first pleated shade, four magnetic reed relay switches, a cord lock, two second top bracket assemblies, two second bottom bracket assemblies, four magnets and a continuous conductive wire and which has been constructed in accordance with the principles of the eighth embodiment.
Figure 25:
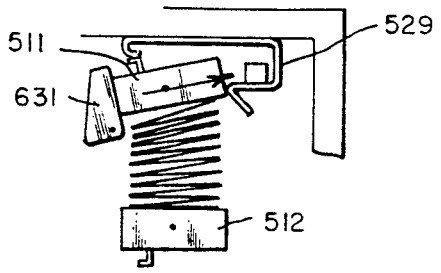
FIG. 25 is a side elevational view of the eighth combined alarm system and shade assembly of FIG. 24 as the third top housing assemblies is being placed in the two second top bracket assemblies.
Figure 26:
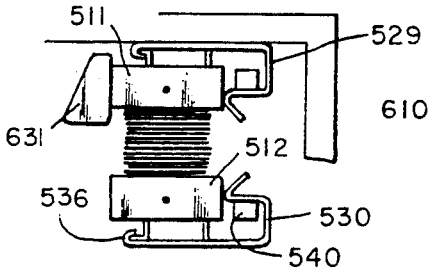
FIG. 26 is a side elevational view of the eighth combined alarm system and shade assembly of FIG. 24 as the third bottom housing assembly is being placed in the two second bottom bracket assemblies after the third top housing assembly has been placed in the two second top bracket assemblies.
Figure 27:
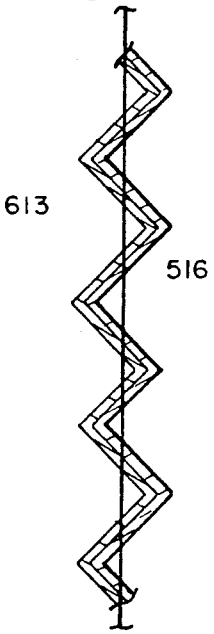
FIG. 27 is a side elevational view in cross-section of the first pleated shade of the eighth combined alarm system and shade assembly of FIG. 24 which has a first sheet and a second sheet.

Referring to FIG. 24 in conjunction with FIG. 25, FIG. 26, FIG. 27 and FIG. 30 a second combined alarm system and shade assembly 610 includes the third top housing assembly 511, the third bottom housing assembly 512, a first pleated shade 613 having a top edge 614 and a bottom edge 615, the continuous conductive wire 516 the first magnetic reed relay switch 40 and the second magnetic reed relay switch 46. U.S. Pat. No. 4,974,656 teaches a pleated shade which may be used to make the first pleated shade 613. The first pleated shade 613 is mechanically coupled to the first elongated rail 519 adjacent to the first end 614 thereof. The first elongated rail 519 is slidably coupled to the first elongated, hollow rectangular member 517 so that the first pleated shade 613 extends through the slot 518 of the first elongated, hollow rectangular member 517. The first pleated shade 613 is mechanically coupled to the second elongated rail 524 adjacent to the second end 615 thereof. The second elongated rail 525 is slidably coupled to the second elongated, hollow rectangular member 523 so that the first pleated shade 613 extends through the slot 524 of the second elongated, hollow rectangular member 523. The second combined alarm system and shade assembly 610 also includes the two top bracket assemblies 529, the two bottom bracket assemblies 530 and a cord lock 631. U.S. Pat. No. 4,913,210 teaches a cord lock for a pleated shade. The continuous conductive wire 516 makes a plurality of round-trips each of which extends from the third top housing assembly 511 down through the first pleated shade 613 to the third bottom housing assembly 512 and from the third bottom housing assembly 512 up through the first pleated shade 613 to the third top housing assembly 511.

Figure 28:
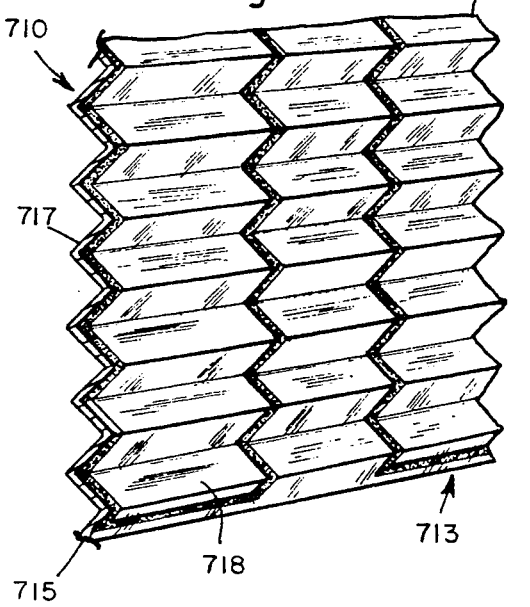
FIG. 28 is a perspective view of a first sheet and a continuous conductive path of a second pleated shade for use in a third combined alarm system and shade assembly including a third top housing assembly, a third bottom housing assembly, four magnetic reed relay switches, a cord lock, two second top bracket assemblies, two second bottom bracket assemblies, four magnets and a continuous conductive wire and which has been constructed in accordance with the principles of the ninth embodiment.
Figure 29:
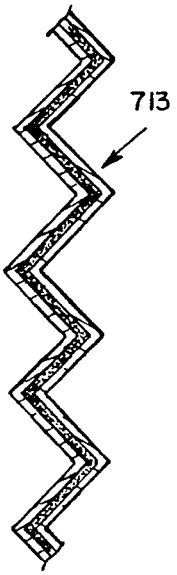
FIG. 29 is a side elevational view in cross-section of the second pleated shade of FIG. 28 which includes the first sheet, the continuous conductive path and a second pleated sheet.

Referring to FIG. 28 in conjunction with FIG. 27, FIG. 28, FIG. 29 and FIG. 30 a third combined alarm system and shade assembly 710 includes the third top housing assembly 511, the third bottom housing assembly 512, a second pleated shade 713 having a top edge 714 and a bottom edge 715, a continuous conductive path 716, the first magnetic reed relay switch 40 and the second magnetic reed relay switch 46. U.S. Pat. No. 4,862,941 teach a pleated shade which may be used to make the second pleated shade 713. The second pleated shade 713 includes a first pleated sheet 717 and a second pleated sheet 718 which are spaced apart in substantially parallel array by the third top and bottom housing assemblies 511 and 512. The continuous conductive path 716 is formed by applying a layer of flexible and electrically conductive coating composition to the first pleated sheet. U.S. Pat. No. 4,999,608 teaches the use of an elongated path of flexible and electrically conductive coating composition which is applied to a screen mesh in a predetermined and non-overlapping pattern. The second pleated shade 713 is mechanically coupled to the first elongated rail 519 adjacent to the first edge 714 thereof. The first elongated rail 519 is slidably coupled to the first elongated, hollow rectangular member 517 so that the second pleated shade 713 extends through the slot 518 of the first elongated, hollow rectangular member 517. The second pleated shade 713 is mechanically coupled to the second elongated rail 524 adjacent to the second edge 715 thereof. The second elongated rail 525 is slidably coupled to the second elongated, hollow rectangular member 523 so that the second pleated shade 713 extends through the slot 524 of the second elongated, hollow rectangular member 523. The third combined alarm system and shade assembly 710 also includes the two top bracket assemblies 529, the two bottom bracket assemblies 530 and the cord lock 631. U.S. Pat. No. 4,913,210 teaches a cord lock for a pleated shade. The continuous conductive path 716 makes a plurality of round-trips each of which extends from the third top housing assembly 511 down through the second pleated shade 713 to the third bottom housing assembly 512 and from the third bottom housing assembly 512 up through the second pleated shade 713 to the third top housing assembly 511.

Referring to FIG. 30 in conjunction with FIG. 31, FIG. 32 and FIG. 33 a first combined alarm system and screen assembly 810 includes the third top housing assembly 511, the third bottom housing assembly 512, a screen mesh 813 having a top edge 814 and a bottom edge 815, a continuous conductive wire 516, the first magnetic reed relay switch 40 and the second magnetic reed relay switch 46. U.S. Pat. No. 4,146,293 teaches a combined alarm system and screen assembly includes a screen mesh and a continuous conductive wire which may be sewn, glued or interwoven onto the screen mesh 813. The third top housing assembly 511 includes a first elongated, hollow rectangular member 517 with a slot 518 extending lengthwise along the top surface thereof and a second elongated rail 519 with a first channel 520 and a second channel 521 each of which extends lengthwise along the bottom inner surface thereof. The third top housing assembly 511 also includes two caps 819 each of which is disposed at one end thereof. Each of the two L-shaped flanges 522 may be mechanically coupled to the first elongated, hollow rectangular member 517 and disposed on the bottom outer surface thereof. The screen mesh 813 is mechanically coupled to the first elongated rail 519 adjacent to the first edge 814 thereof. The first elongated rail 519 is slidably coupled to the first elongated, hollow rectangular member 517 so that the screen mesh 813 extends through the slot 518 of the first elongated, hollow rectangular member 517. The third top housing assembly 511 also includes a first spline 829 and a first elongated elastic member 830. The first spline 829 is disposed in the first channel 520 of the first elongated rail 519 and which secures the screen mesh 813 within the third top housing assembly 511. The first elongated elastic member 830 is disposed along with the screen mesh 813 between the first elongated, hollow rectangular member 517 and the second channel 521 of the first elongated rail 519 and functions as a first tensioning mechanism for taking up any slack in the screen mesh 813. One of the first magnetic reed relay switches 40 is disposed in the first channel 520 of the first elongated rail 519 at each end thereof. The third bottom housing assembly 512 includes a second elongated, hollow rectangular member 523 with a slot 524 extending lengthwise along the top surface thereof and a second elongated rail 525 with a first channel 526 and a second channel 527 each of which extends lengthwise along the bottom inner surface thereof. The third bottom housing assembly 512 also includes two caps 820 (FIGS. 30 and 34) each of which is disposed at one end thereof. Each of the two L-shaped flanges 528 may be mechanically coupled to the second elongated, hollow rectangular member 523 and disposed on the bottom outer surface thereof. One of the second magnetic reed relay switches 46 is disposed in the first channel 526 of the second elongated rail 525 at each end thereof. The screen mesh 813 is mechanically coupled to the second elongated rail 524 adjacent to the second edge 815 thereof. The second elongated rail 525 is slidably coupled to the second elongated, hollow rectangular member 523 so that the screen mesh 813 extends through the slot 524 of the second elongated, hollow rectangular member 523. The third bottom housing assembly 512 also includes a second spline 831 and a second elongated elastic member 832. The second spline 831 is disposed in the first channel 526 of the second elongated rail 525 and secures the screen mesh 813 within the third bottom housing assembly 512. The second elongated elastic member 832 is disposed along with the screen mesh 813 between the second elongated, hollow rectangular member 523 and the second channel 527 of the second elongated rail 525 and functions as a second tensioning mechanism for taking up any slack in the screen mesh 813. The first combined alarm system and shade assembly 510 may also include the two top bracket assemblies 529, the two bottom bracket assemblies 530 and a cord lock 531. U.S. Pat. No. 4,982,776 and U.S. Pat. No. 4,913,210 teach cord locks. Each top bracket assembly 529 includes a first i-shaped member 531 with a first crook 532 and a first bore 533, a first mounting screw 534 and a first magnet 535. Each bottom bracket assembly 530 includes a second J-shaped member 536 with a second crook 537 and a second bore 538, a second mounting screw 539 and a second magnet 540. The continuous conductive wire 516 has a first end and a second end and extends from the third top housing assembly 511 down to the third bottom housing assembly 512 and from the third bottom housing 512 to the third top housing assembly 511. The first and second magnetic reed relay switch 40 and 46 electrically couple the severed portions of the continuous conductive wire 516 back together in the presence of the first and second magnets 535 and 540. The continuous conductive wire 516 makes a plurality of round-trips each of which extends from the third top housing assembly 511 down through the screen mesh 813 to the third bottom housing assembly 512 and from the third bottom housing assembly 512 up through the screen mesh 813 to the third top housing assembly 511. The screen mesh 813 is formed from a sheet of screen material and has marginal edge portions which are adapted to be secured to a frame.

From the foregoing it can be seen that a combined alarm system and window covering assembly has been described. In all of the embodiments described above an optical fiber which U.S. Pat. No. 4,234,875 teaches may be used in place of a conductive wire. It should be noted that the drawings are not drawn to scale and that distances between the figures and their relative sizes are not to be considered significant.

It is intended that the foregoing descriptions and showings made in the drawings shall be considered only as an illustration of the principles of the present invention and may be embodied in a variety of forms by one skilled in the art.

What is claimed is:

1. A combined alarm system and window covering assembly for use with an alarm device having a first input terminal and a second input terminal, said combined alarm system and window covering assembly comprising:

a. a top housing;

b. a bottom rail;

c. a covering mechanically coupled to said top housing and said bottom rail; and d. a conductive wire which has a first end and a second end and which extends from said top housing down to said bottom rail and up from said bottom rail to said top housing, said first and second ends of said conductive wire being electrically coupled to the first and second input terminals of the alarm system, said conductive wire being coupled with said bottom rail as a main pull string for raising and lowering said bottom rail and said covering.

2. A combined alarm system and window covering assembly according to claim 1 wherein said covering comprises:

a. a plurality of individual slats each of which has a first slot and a second slot, which is spaced apart from said first slot;

b. a first string ladder support system which has a front vertical ladder string and a back vertical ladder string with short support strings fastened between said front and back vertical ladder strings and which is mechanically coupled to said top housing and said bottom rail, each of said short support strings of said first string ladder support system supporting one of said individual slats contiguous to said first slot thereof;

c. a second string ladder support system which has a front vertical ladder string and a back vertical ladder string with short support strings fastened between said front and back vertical ladder strings and which is mechanically coupled to said top housing and said bottom rail, each of said short support strings of said second string ladder support system supporting one of said individual slats contiguous to said second slot thereof wherein said conductive wire extends from said top housing down through each of said first slots of said slats to said bottom rail and from said bottom rail through each of said second slots of said slats to said top housing;

d. a tilt rod which is disposed in and rotatively coupled to said top housing and which is fixedly coupled to said first and second string ladder support systems; and d. tilting means for tilting said tilt rod.

3. A combined alarm system and window covering assembly according to claim 2, said combined alarm system and window covering assembly also comprising:

a. a pull string which includes a capsule member into which said first and second ends of said continuous conductive wire are threaded through said top housing, a pull tab and a cord which mechanically couples said pull tab to said capsule; and b. locking means for locking said continuous conductive wire, said locking means being mechanically coupled to said top housing.

4. A combined alarm system and window covering assembly according to claim 2, said combined alarm system and window covering assembly also comprising:

a. a pull string which includes a capsule member into which said first and second ends of said continuous conductive wire are threaded through said top housing, a pull tab and a cord which mechanically couples said pull tab to said capsule; and b. winding means for winding and unwinding said continuous conductive wire, said winding means being mechanically coupled to said top housing.

5. A combined alarm system and window covering assembly according to claim 4 wherein said winding means comprises:

a. a tilt rod;

b. a cap which is mounted to one end of said top housing and which includes a bushing and a sleeve which is connected to said tilt rod and which is rotatably supported in the bushing;

c. a first worm gear which is located within said cap and which is connected to said sleeve; and d. a second worm gear which is disposed on and mechanically coupled to said tilt rod which is accessible from outside said cap and which is operatively connected to said first worm gear for rotating said first worm gear.

6. A combined alarm system and window covering assembly according to claim 4 wherein said winding means comprises:

a. a tilt rod;

b. a cap which is mounted to one end of said top housing and which includes a bushing and a sleeve which is connected to said tilt rod and which is rotatably supported in the bushing;

c. a sprocket wheel which is located within said cap and which is connected to said sleeve and which is accessible from outside said cap; and d. a bead chain which passes over said sprocket wheel for rotating said sprocket wheel.

7. A combined alarm system and window covering assembly according to claim 1 wherein said covering comprises a single honeycomb shade which is mechanically coupled to said top housing and said bottom rail wherein said conductive wire is mechanically coupled to said single honeycomb shade.

8. A combined alarm system and window covering assembly according to claim 1 wherein said covering comprises a double honeycomb shade which is mechanically coupled to said top housing and said bottom rail wherein said conductive wire is mechanically coupled to said double honeycomb shade.

* * * * *